US007077206B2

(12) United States Patent
Kennedy et al.

(10) Patent No.: US 7,077,206 B2
(45) **Date of Patent: *Jul. 18, 2006**

(54) METHOD AND APPARATUS INVOLVING AN INTEGRATED OR OTHERWISE COMBINED EXIT GUIDE AND SECTION MILL FOR SIDETRACKING OR DIRECTIONAL DRILLING FROM EXISTING WELLBORES

(75) Inventors: Michael D. Kennedy, Houston, TX (US); Neil D. Shappert, Missouri City, TX (US)

(73) Assignee: Re-Entry Technologies, Inc., Houston, TX (US)

( * ) Notice: Subject to any disclaimer, the term of this patent is extended or adjusted under 35 U.S.C. 154(b) by 158 days.

This patent is subject to a terminal disclaimer.

(21) Appl. No.: 10/166,193

(22) Filed: Jun. 10, 2002

(65) Prior Publication Data

US 2003/0098152 A1 May 29, 2003

Related U.S. Application Data

(63) Continuation-in-part of application No. 09/583,153, filed on May 30, 2000, now Pat. No. 6,401,821.

(60) Provisional application No. 60/171,903, filed on Dec. 23, 1999.

(51) Int. Cl.
*E21B 7/08* (2006.01)
*E21B 29/06* (2006.01)

(52) U.S. Cl. ..... 166/313; 166/55.7; 166/117.6; 166/297

(58) Field of Classification Search ..... 166/297, 166/313, 50, 55, 55.1, 117.5, 117.6, 298, 166/55.6

See application file for complete search history.

(56) References Cited

U.S. PATENT DOCUMENTS

| | | | | | |
|---|---|---|---|---|---|
| 5,070,952 | A | * | 12/1991 | Neff | 175/426 |
| 5,429,187 | A | * | 7/1995 | Beagrie et al. | 166/55.1 |
| 5,467,820 | A | * | 11/1995 | Sieber | 166/117.6 |
| 5,566,757 | A | * | 10/1996 | Carpenter et al. | 166/285 |
| 5,584,350 | A | * | 12/1996 | Schnitker et al. | 175/61 |
| 5,787,978 | A | * | 8/1998 | Carter et al. | 166/117.6 |
| 5,806,595 | A | * | 9/1998 | Langford et al. | 166/298 |
| 5,806,600 | A | * | 9/1998 | Halford, Sr. | 166/382 |
| 5,810,079 | A | * | 9/1998 | Lynde et al. | 166/55.6 |
| 5,813,465 | A | * | 9/1998 | Terrell et al. | 166/298 |
| 5,881,808 | A | * | 3/1999 | Rehbock et al. | 166/117.5 |
| 5,899,268 | A | * | 5/1999 | Lynde et al. | 166/55.6 |
| 5,944,101 | A | * | 8/1999 | Hearn | 166/117.5 |
| 6,024,168 | A | * | 2/2000 | Kuck et al. | 166/297 |
| 6,241,021 | B1 | * | 6/2001 | Bowling | 166/380 |

(Continued)

*Primary Examiner*—Jennifer H. Gay
(74) *Attorney, Agent, or Firm*—The Matthews Firm

(57) ABSTRACT

A section mill is positioned below an exit guide in a drill string assembly used to mill a section of steel casing below the whipstock and which as the section mill moves down and mills along the section of casing, causes the whipstock to be lowered down adjacent the milled-out casing and allows the drill bit and drill string to be run along the surface of the exit guide and into the earth formation. Alternatively, the section mill is positioned above the exit guide in a drill string assembly after the section mill has milled out in an appropriate length of the steel casing, the tubing string pulls both the section mill and the exit guide up to a position where the exit guide is adjacent the area of formation which has been exposed by milling along the steel casing.

40 Claims, 15 Drawing Sheets

U.S. PATENT DOCUMENTS 6,283,208 B1 * 9/2001 George et al. ..... 166/255.3
6,419,024 B1 * 7/2002 George et al. ..... 166/377
6,497,288 B1 * 12/2002 George et al. ..... 166/377
6,648,068 B1 * 11/2003 Dewey et al. ..... 166/50
2002/0096325 A1 * 7/2002 Sonnier ..... 166/255.3
2002/0162658 A1 * 11/2002 Delgado et al. ..... 166/298

* cited by examiner

METHOD AND APPARATUS INVOLVING AN INTEGRATED OR OTHERWISE COMBINED EXIT GUIDE AND SECTION MILL FOR SIDETRACKING OR DIRECTIONAL DRILLING FROM EXISTING WELLBORES

RELATED APPLICATION

This Application is a Continuation-In-Part of U.S. patent application Ser. No. 09/583,153, filed on May 30, 2000, now U.S. Pat. No. 6,401,821, issued Jun. 11, 2002, and also claims priority from U.S. Provisional Patent Application Ser. No. 60/171,903, filed Dec. 23, 1999.

FIELD OF INVENTION

This invention relates, generally, to method and apparatus for the sidetracking or directional drilling from existing wellbores, cased or uncased, and more specifically, to the sidetracking or directional drilling of such wells which may or may not be required to be oriented in a predetermined direction from such existing wells.

BACKGROUND OF THE INVENTION

It is well known in the art to exit existing wellbores which may be vertical or angled from the vertical. Such exit wells may be drilled merely to sidetrack the existing wellbores, or may be used for directional drilling. Such exit wells may be drilled at any angle or direction, predetermined or unknown, from the existing wellbores.

In the conventional art, when the existing wellbore is cased, typically with a steel casing, it is known to remove a section of the casing to allow the drill bit to begin cutting the exit well, or to merely cut a window in the steel casing and use a whipstock to direct the drill bit into the adjacent formation. The use of such whipstocks is well-known in the art, for example, in the following United States patents:

U.S. Pat. No. 5,109,924
U.S. Pat. No. 5,551,509
U.S. Pat. No. 5,647,436
U.S. Pat. No. 4,182,423
U.S. Pat. No. 5,806,596
U.S. Pat. No. 5,771,972
U.S. Pat. No. 5,592,991
U.S. Pat. No. 5,636,692

Thus it has been conventional in this art to use a whipstock in conjunction with a so-called "window mill". With such configurations, the whipstock is oriented so that it will determine the direction in which the drill bit is eventually to be run through the window cut by the window mill and thus into the formation into which the exit well is to be drilled.

It is also known in this art to use a section mill but without a whipstock. When using the section mill, the mill is used to cut away an entire section of the casing, sometimes 80 to 100 ft. of the casing string, and then that section of the borehole from which the casing has been cut away is pumped full of cement. Once the cement has hardened, conventional sidetracking or directional drilling techniques can be used which do not depend upon the use of a whipstock. Such sectional mills are conventional and are available from various downhole tool companies. For example, a section mill is available from the Baker Oil Tools Division of Baker Hughes, Inc. located in Houston, Tex., such as their Model "D" Section Mill, Product No. 150-72. Such section mills known in this art typically use knives which are hydraulically operated to extend into and cut through the steel casing.

To the best of Applicant's knowledge, those in this art have neither recognized nor utilized a combination of an exit guide with a section mill.

BRIEF DESCRIPTION OF DRAWINGS

For a further understanding of the nature and objects of the present invention, reference should be had to the following brief description of the drawings, wherein.

DETAILED DESCRIPTION OF THE PREFERRED EMBODIMENT

Figure 1:
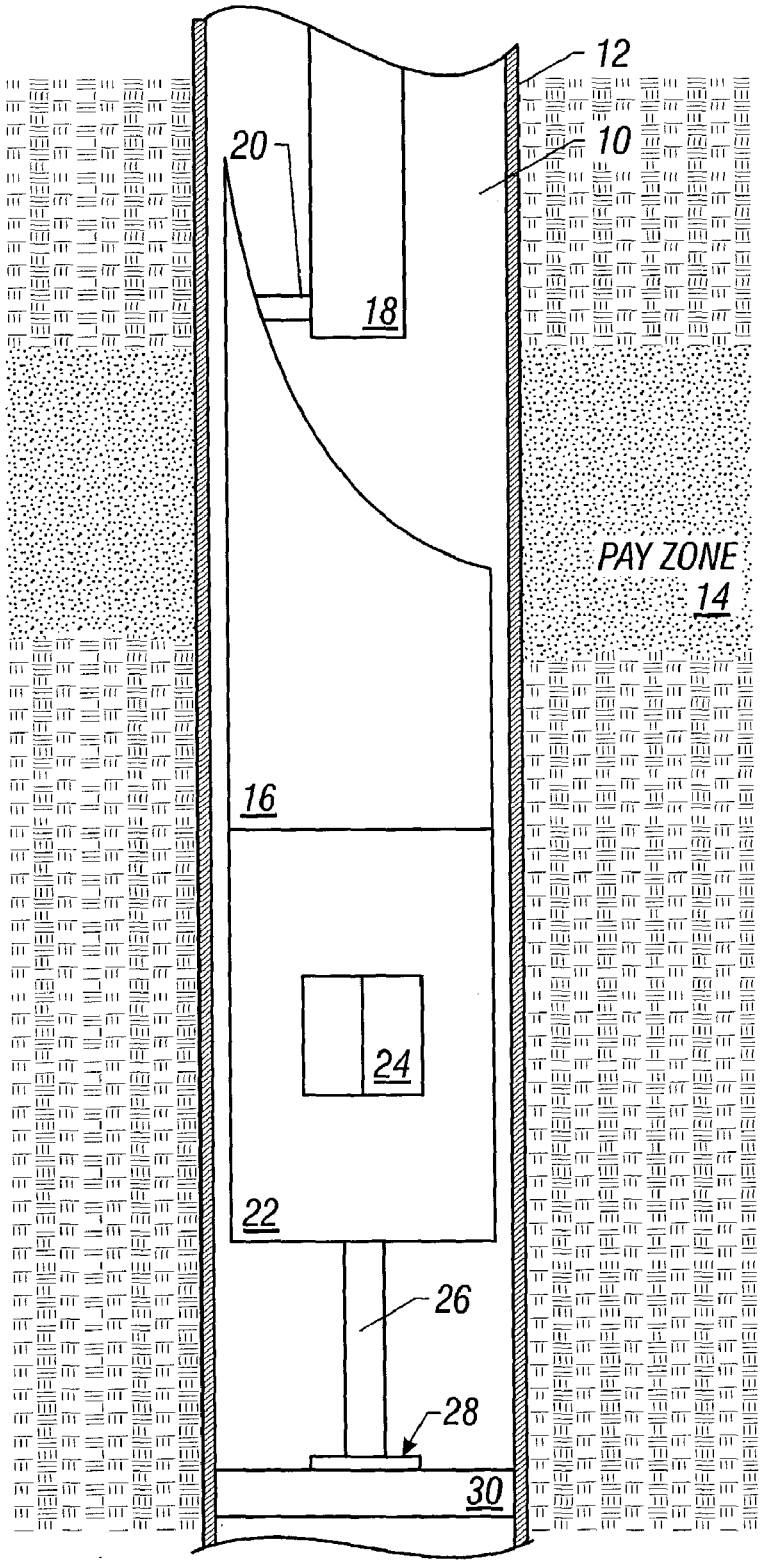
FIG. 1 (Prior Art)
FIG. 1 is an elevated, diagrammatic view, partly in cross section, of a whipstock apparatus known in the prior art which is used to drill into a pay zone through a window in a casing wall.

Referring now to the drawings in more detail, FIG. 1 illustrates a cased borehole 10 having a steel casing 12 which traverses a pay zone 14 into which a horizontal well is proposed to be drilled. In the practice of the prior art illustrated in FIG. 1, a whipstock 16 is run into the cased borehole 10 by the use of a tubular, for example, a string of drill pipe 18 which is connected to the whipstock 16 by a shear pin 20. Threadedly connected to the whipstock 16 is a sub 22 which has a pair of slips 24, only one of which is illustrated, with the other such slip being 180 degrees around the periphery of the sub 22. A piston rod 26 which travels within the interior of the sub 22 has its lower end a pedestal 28 which in use rests against a bridge plug 30, sometimes referred to as an anchor in this art, which is set within the casing 12.

In the use of the prior art system as illustrated in FIG. 1, the combination of the whipstock 16 and the slip sub 22 is run into the cased borehole 10 by running the drill pipe 18 into the borehole until the pedestal 28 sits down on the anchor 30. By continuing to lower the drill pipe 18 from the earth's surface, the piston rod 26 moves within the sub 22 to activate the slips 24 which causes them to engage against the side wall of the casing 12 and prevent further vertical movement of the combination. By continuing to lower the drill pipe 18, the shear pin 20 is sheared off and the drill pipe 18 can be removed from the borehole.

As is well-known in this art, one or more window mills are then attached to the drill pipe 18 and the window mills are then used to drill through the casing 12, forming a window. The drill pipe is then removed and a formation type drill bit is attached to the drill string 18 and the well is drilled off of the curvature of the whipstock 16 through the window, into the pay zone 14 as far as is desired.

Figure 2:
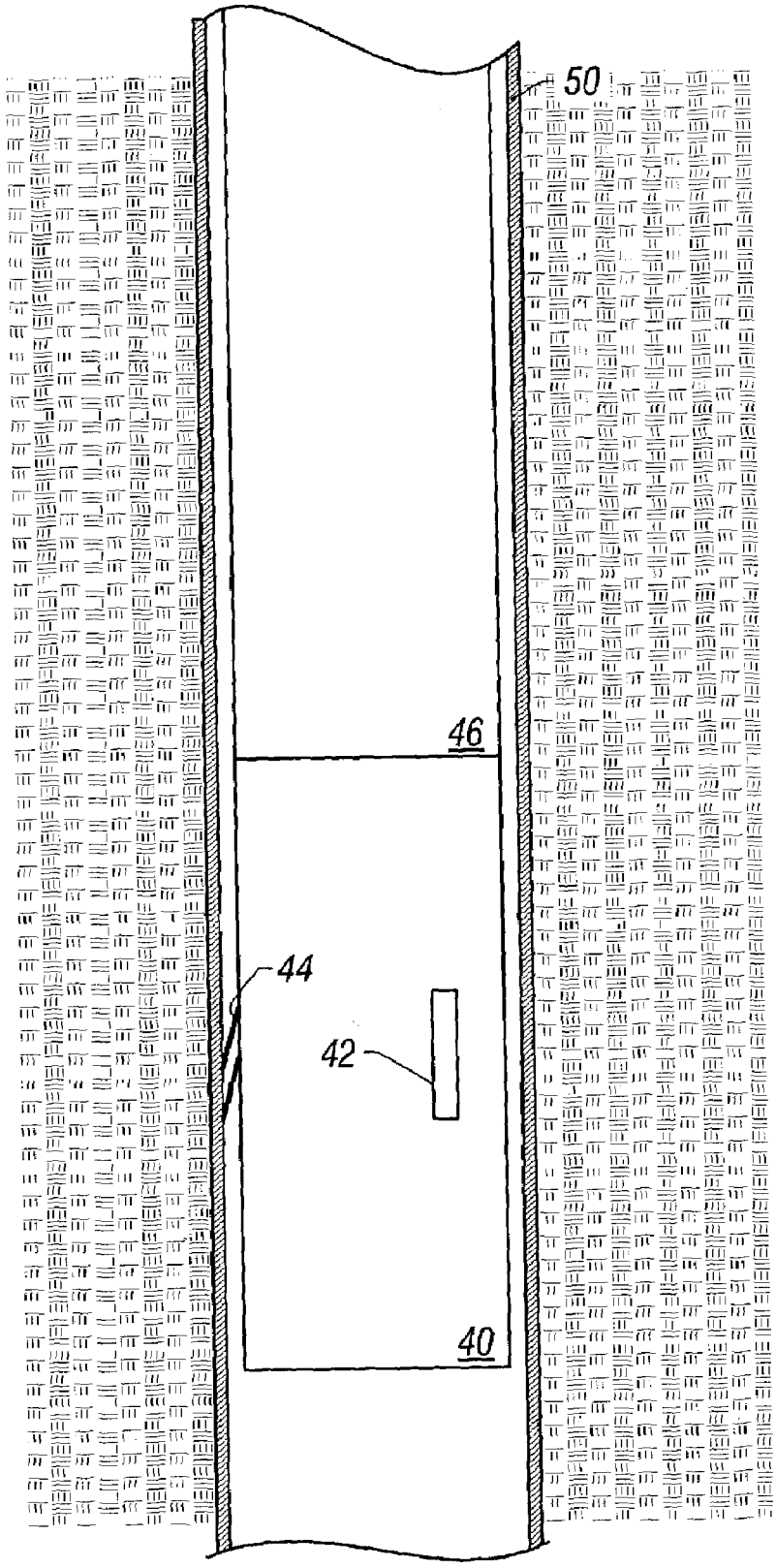
FIG. 2 (Prior Art)
FIG. 2 is an elevated, diagrammatic view, partly in cross section, of a section mill which is used in the prior art to cut away a section of the steel casing in a pre-existing well.
Figure 3:
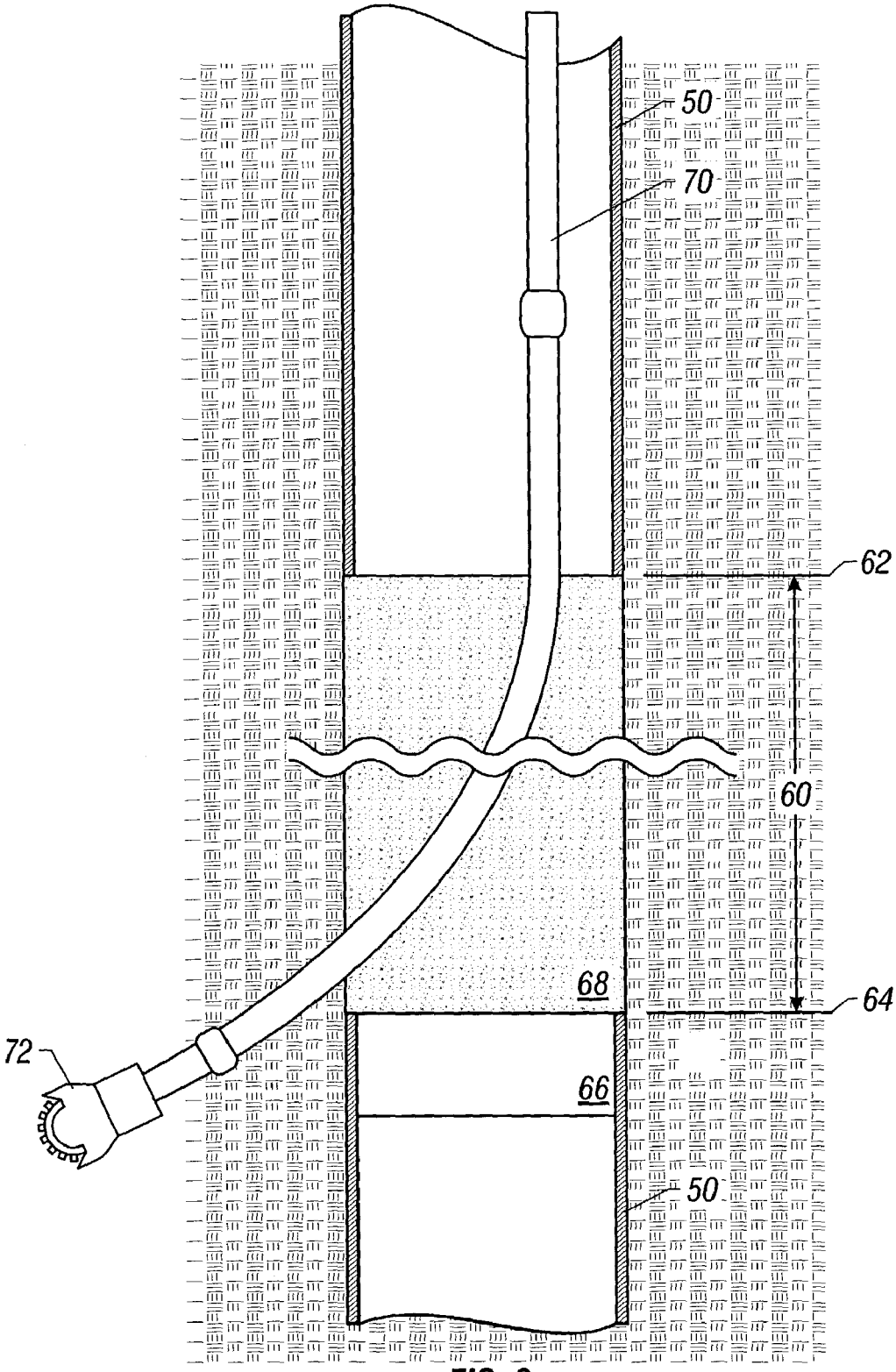
FIG. 3 (Prior Art)
FIG. 3 is an elevated view, partly in cross section, showing the manner in which the prior art has used the boreholes formerly cased, but cut away by the section mill illustrated in FIG. 2, and the manner in which directional drills are drilled through a section of concrete in a conventional manner.

Referring now to FIG. 2, an entirely different mode of operation is described in which a conventional section mill 40 is threadedly connected to a string of tubulars, for example, the drill pipe 41. When the desired depth is reached, a trio of blades 42, 44 and a non-illustrated third blade are hydraulically actuated using fluid from the earth's surface to expand and engage the casing 50. A non-illustrated third blade is hidden in this view, being on the other side of the section mill 40. As is well-known in this art, the blades 42, 44 and a non-illustrated third blade must be cooled by liquid from the earth's surface to keep them from being destroyed merely by their action in cutting the casing 50. It is a common practice in the art that once the desired depth is reached by the apparatus illustrated in FIG. 2, the fluid pressure from the earth's surface is commenced, causing the blades 42,44 and a non-illustrated third blade to expand into the casing 50 and commence cutting the casing 50. By rotating the drill pipe 41, the casing 50 is completely severed. Because the casing is cemented against the earth's formation, the remaining casing stays in place. Thereafter, merely by lowering the drill pipe 41, the blades 42, 44 and a non-illustrated third blade will cut away the casing 50 for as long as the drill pipe 41 continues to be lowered. A cement plug 66, illustrated in FIG. 3, is placed within the cased borehole to prevent the cement from going further into the borehole below the predetermined depth 64 along the casing 50. Cement 68 is then filled in the borehole between the points 62 and 64, identified as the distance 60 between those points, which typically will be on the order of 80 to 100 ft. As soon as the cement 68 has hardened, a drill string 70 having a drill bit 72 at its lower end is used to drill through the cement section 68 using conventional directional drilling techniques. Quite often, the portion of the drill string 70 being used to drill through the cement 68 has articulated joints which allows it to make the curvature illustrated in FIG. 3 to drill out through the cement 68 into the adjoining formation. The distance 60 must be quite lengthy when using this technique, for example, 80 to 100 ft., to allow the radius of curvature of the pipe 70 to coincide with the desired destination within the formations surrounding the cased borehole.

Figure 4:
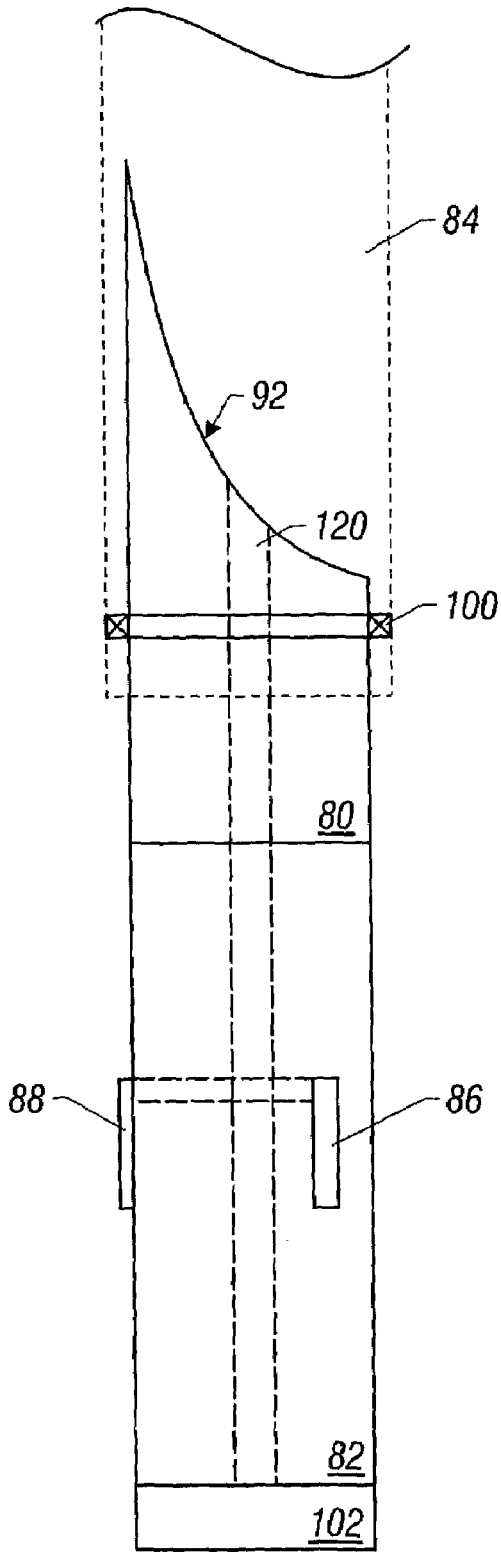
FIG. 4 is an elevated, diagrammatic view of the combination according to the present invention in which a whipstock or other exit guide is used with a section mill.

Referring to FIG. 4, there is illustrated the apparatus according to the present invention which includes a whipstock 80 or another conventional exit guide which is threadedly connected to a section mill 82. An on-off tool 84 is connected to a drill pipe such as the drill pipe 18 of FIG. 1 or the drill string 70 of FIG. 3 to run the whipstock and section mill 82 into the depth of interest within a cased borehole. When the depth of interest is reached, the blades 86, 88 and a third non-illustrated blade (with the third blade not being illustrated since it is hidden behind the section mill 82) are hydraulically actuated, thus causing the casing to be severed. By continually lowering the drill pipe and the on-off tool 84, the blades 86, 88 and the third blade, will cut away the casing, but for a much shorter distance, typically cutting away a length approximately the distance between the uppermost point 91 of the whipstock 80 and 2–3 ft. below the blades 86, 88 and the third blade. This causes the whipstock 80, and in particular its curved section 92, to be adjacent to the pay zone of interest, illustrated in FIG. 6. The blades 86, 88 and the third blade rest against the top portion of the casing, i.e., that portion of the casing which has yet not been cut away by the blades, so that the ceasing rotation of the drill pipe and the on-off tool 84, the blades 86, 88 and the third blade will merely rest against the top of the uncut away casing and prevent the tool from being lowered any further into the cased borehole. By adding additional weight to the drill pipe and the on-off tool 84, the shear pin or pins in the connector 110 will be sheared and the on-off tool 84 and drill pipe suspending the on-off tool 84 can be removed from the well, thus leaving the whipstock 80 and the section mill 82 in place within the borehole. The curved section 92 of the whipstock 80 thus being adjacent to the pay zone within the formation, a drill pipe and conventional drill bit can be lowered into the borehole and drilled into the adjacent formation as the drill bit and drill pipe runs against the curved surface 92 of the whipstock 80.

If it is desired to pull the apparatus illustrated in FIG. 4 out of the borehole, the on-off tool 84 threadedly connected to a drill pipe (not illustrated) can be run back into the borehole and can swallow up the whipstock 80 by engaging the latch mechanism 100. By then rotating the apparatus 80 and 82, without having the fluid pump at the earth's surface turned on, the blades 86, 88 and the third blade will bum off from a lack of cooling and the drill pipe supporting the on-off tool 84 can then be withdrawn from the borehole since the blades 86, 88 and the third blade will no longer be protruding against the casing wall.

Figure 5:
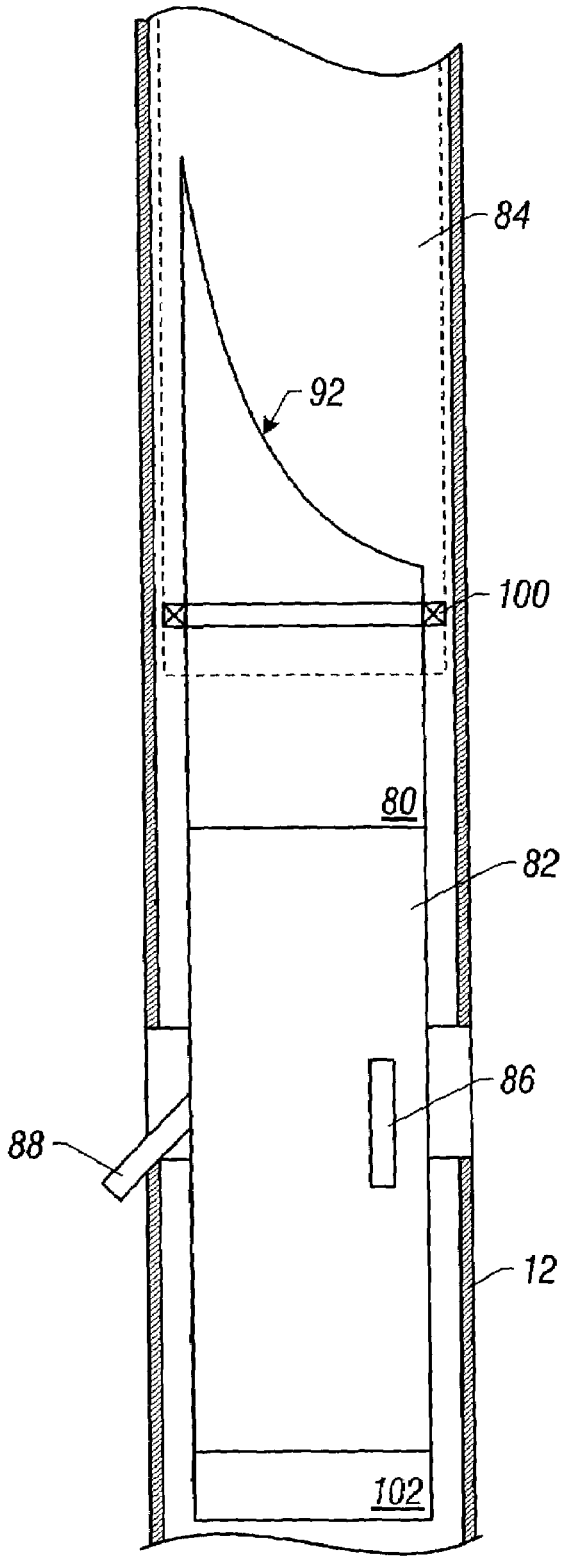
FIG. 5 illustrates in an elevated, diagrammatic view the initial cutting away of the casing in accord with the invention using the combination illustrated in FIG. 4.

Referring now to FIG. 5, the apparatus illustrated in FIG. 4, including the whipstock 80, the section mill 82 and the on-off tool 84, uses a cooling fluid, for example the drilling fluid used to drill the well, to pass from the earth's surface down through a string of drill pipe into the on-off tool 84 and then into a channel 120 formed in the interior of the whipstock 80 and down through the interior of the section mill 82 to provide cooling and the actuation of the section mill blades 86, 88 and the third blade. The fluid passing from the earth's surface down through the channel 120 can also be used to activate the optional packer assembly 102 to anchor the entire assembly against the casing walls if such an optional packer 102 is used. As is illustrated in FIG. 6 hereinafter, the optional packer assembly 102 is illustrated as having its member 122 expanded against the casing 12 to anchor the assembly at a given depth within the casing.

Referring again to FIG. 5, once the fluid has been pumped down from the earth's surface through the drill pipe and the on-off member 84, the blades 86, 88 and the third blade will be moved hydraulically into the casing 12 and by rotating the drill pipe, the blades 86, 88 and the third blade will at first sever the casing 12 and then as the assembly is lowered into the cased borehole, the blades 86, 88 and the third blade will begin to cut away the casing material. In the stage illustrated in FIG. 5, the process has only begun.

Figure 6:
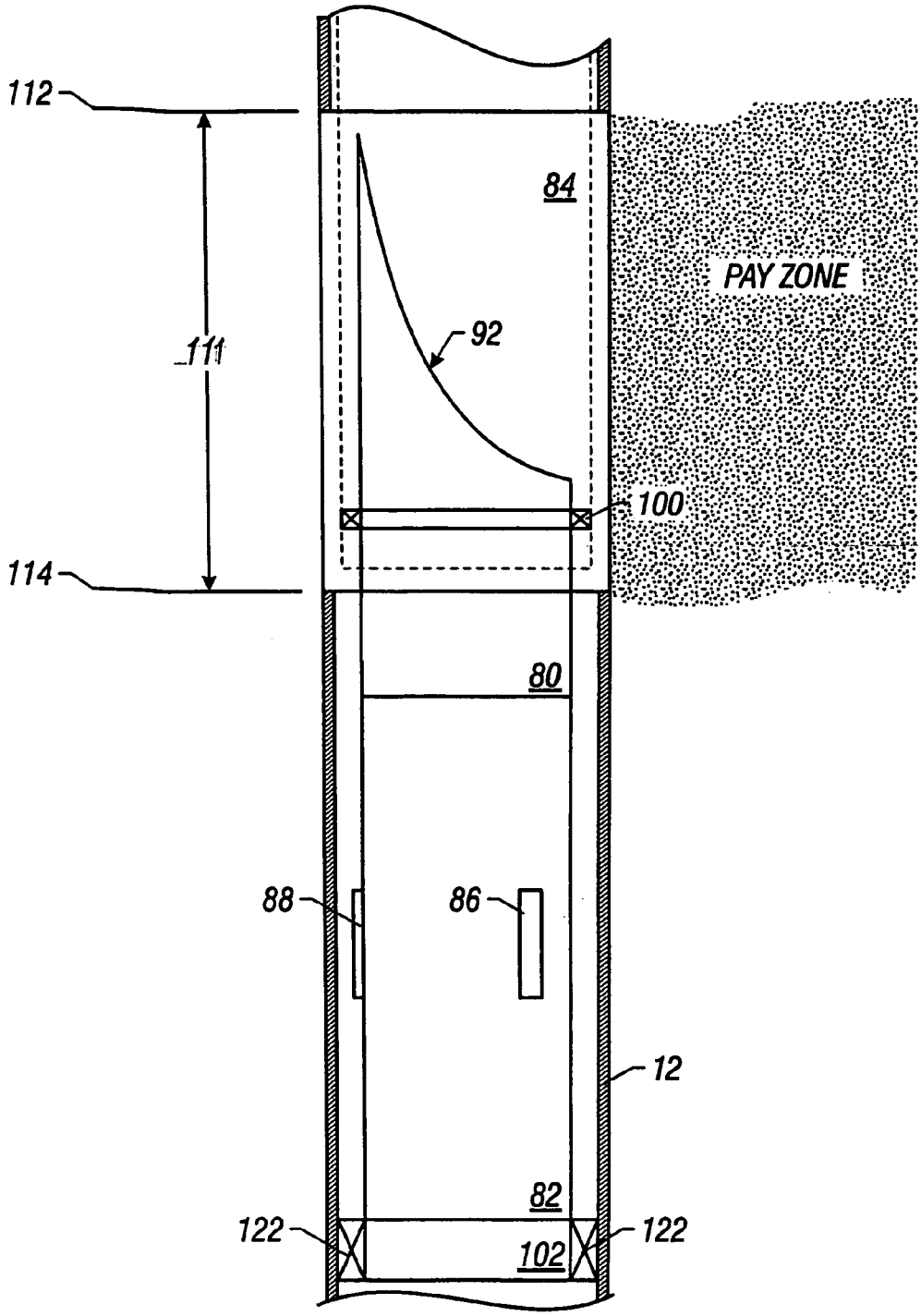
FIG. 6 illustrates in an elevated, diagrammatic view of the completed cutting away of the casing, and the lowering of the whipstock or other exit guide into position adjacent to the portion of the borehole from which the casing has been cut-away.

Referring now to FIG. 6, by continuing to lower the assembly comprised of the whipstock or other exit guide 80, the section mill 82 and the on-off tool 84, while rotating the drill pipe from the earth's surface, the casing 12 will be cut away by a distance which is totally dependent upon the depth to which the assembly has been lowered. In the preferred mode of the invention, the distance 100 is preferably determined to be approximately the distance between point 112 just above the uppermost point 91 of the whipstock 80 and 2–3 ft. below the blades 86, 88 and the third blade. After the casing has been cut away by the blades 86, 88 and the third blade to a predetermined depth, the entire assembly is lowered even further until the curved portion 92 of the whipstock is positioned adjacent to the pay zone 111 as illustrated in FIG. 6. In the alternative embodiment, the further lowering of the assembly to bring the whipstock into proximity to the pay zone 111 is accomplished by turning off the pumps at the earth's surface, thus causing the blades 86, 88 and the third blade to be burned off and to allow the section mill to traverse the cased borehole without further cutting of the casing. The whipstock is oriented in manners well-known in the art by rotating the drill pipe and determining the orientation of the whipstock by standard downhole surveying instrumentation. If the optional hydraulically set packer 102 is utilized, the pump pressure can be against turned on at the earth's surface to provide fluid to the packer 102 and set the packing element 122 to thereby anchor the assembly against the casing wall 12.

Although a packer 122 is mentioned as being optionally available for this process, such a packer need not be used since the blades 86, 88 and the third blade can be resting on top of the uncut casing such as point 114 in FIG. 6 to prevent the apparatus from being lowered further into the cased borehole.

When it is desired to remove the whipstock and the section mill from the borehole, the on-off tool 84 can be run back into the borehole and reconnected onto the latch mechanism 100 which then allows the assembly to be picked up and removed from the borehole.

Figure 7A:
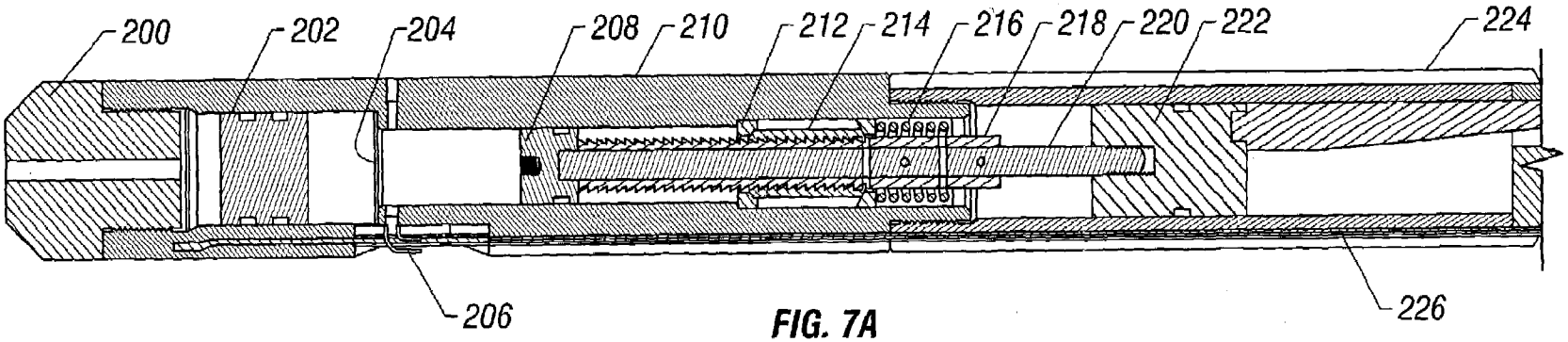
FIGS. 7A–7E, inclusive, together illustrate the preferred embodiment of the present invention.
Figure 7B:
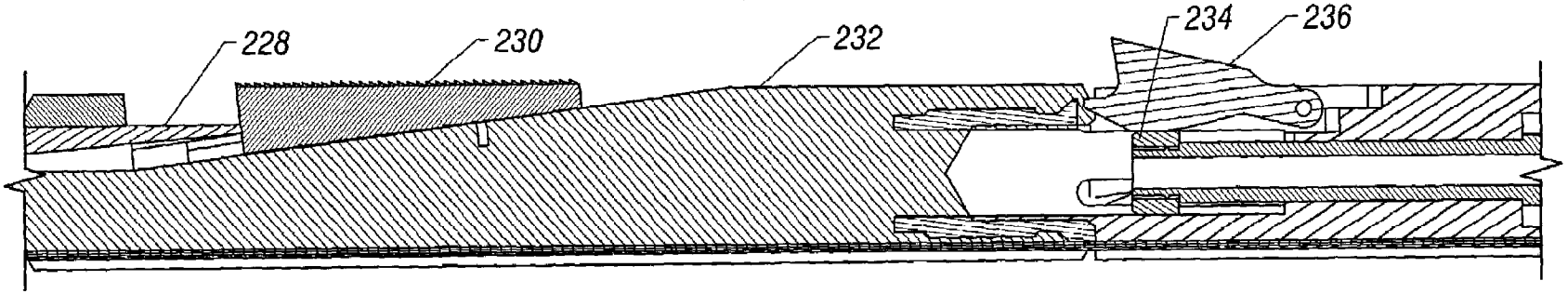
Figure 7C:
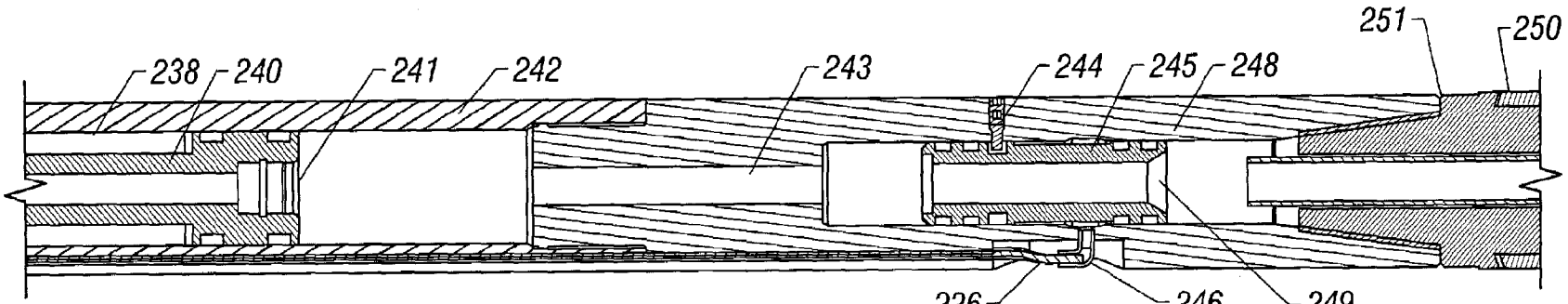
Figure 7D:
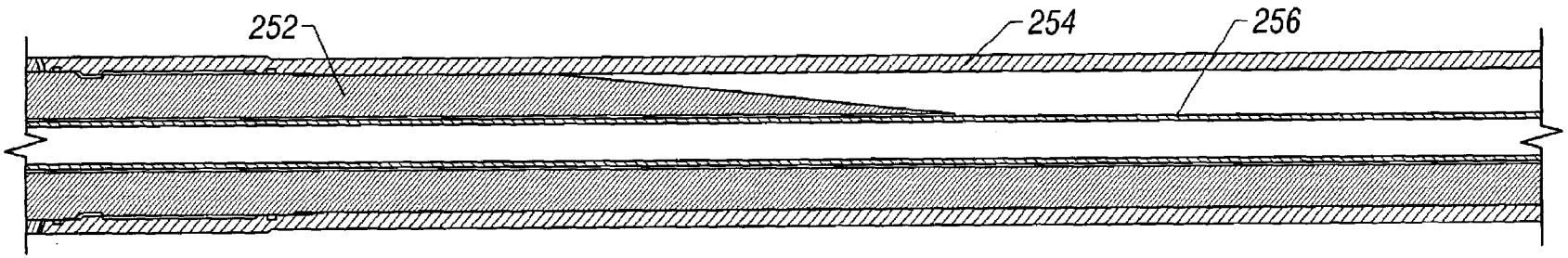
Figure 7E:
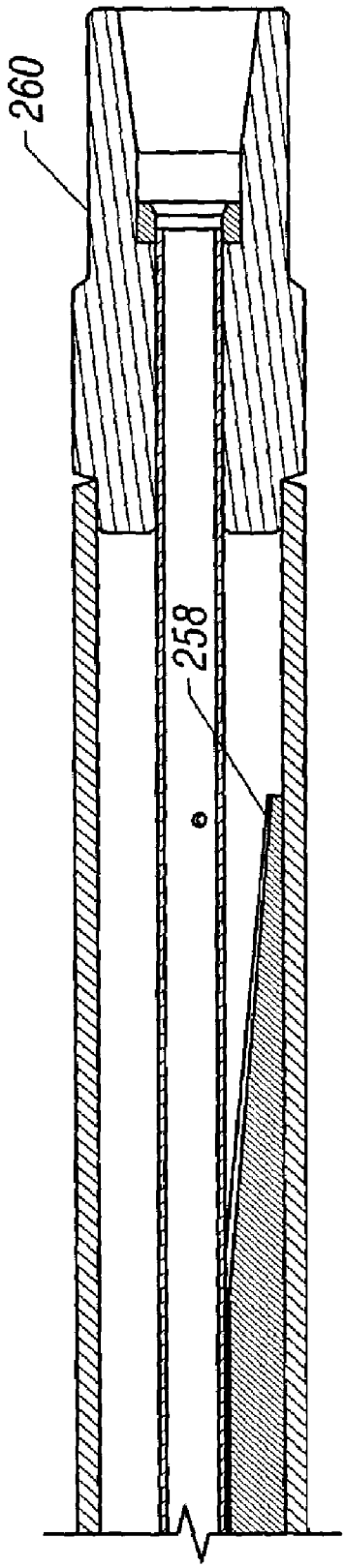

Referring now to FIG'S. 7A–7E, inclusive, the following reference numerals are used to designate some of the various components of the overall tool configuration:

200 Bottom Plug
202 Pressure Compensating Piston
204 Hydraulic Oil Reservoir
206 Hydraulic Oil Line Nipple
208 Latch Piston
210 Latch Housing
212 Latch Ring -continued 214 Latch
216 Load Spring
218 Release Collar
220 Drive Rod
222 Activation Piston
224 Drive Piston Housing
226 Hydraulic Oil Line
228 Drive Pin
230 Slip
232 Hydraulic Bottom Trip Body
234 Activation Nut
236 Cutter Blades
238 Retraction Spring (Not Shown)
240 Activating Piston
242 Section Mill
244 Shear Pin Assy
246 Hydraulic Oil Line Nipple
248 Circulating Sub
250 Release Spring
252 Whipstock
254 Drive Sleeve
256 Ball Carrier Sleeve
258 Top Of Whipstock 252
260 Drive Sub The overall tool configuration is fabricated by having the segment illustrated in FIG. 7A at the lowermost portion of the overall assembly, then FIG. 7B, then FIG. 7C, then FIG. 7D, and finally by having FIG. 7E at the uppermost portion of the overall assembly.

In the operation of the assembly of FIG'S. 7A–7E, a string of tubulars, typically drill pipe (not illustrated) will be threaded into the box end of the drive sub 260. Whenever the assembly of FIG'S. 7A–7E is lowered to the desired depth in the borehole, a fluid, typically a conventional drilling fluid, is pumped through the string of drill pipe from the earth's surface, through the ball carrier sleeve 256, through the interior of the shear piston 245, through the port 243 and through the port 241. The fluid also pushes against the face of activating piston 240 which causes the cutter blades 236 to open and thus commence cutting the steel casing in the borehole.

Once the desired portion of the casing has been cut away, a ball (not illustrated) is dropped from the earth's surface, through the string of drill pipe, through the ball carrier sleeve 256, until the ball seats against the ball seat 249. As soon as the ball seats, the fluid pressure against the piston 245 will shear the shear pin 244, which causes the piston 245 to move down and uncover the hydraulic oil line nipple 246. The fluid will then travel through the hydraulic oil line 226 until reaching the face of the latch piston 208, which then causes the combination of the latch piston 208, the latch 214 and the release collar 218 to rachet up and thus drive the drive rod 220 and drive pin 228 to set the slips 230 against the casing. The slip or slips 230 can be un-set by pulling up on the overall assembly and thus releasing the release collar 218.

To remove the "on-off" section of the assembly, commencing at point 251 in FIG. 7C, the release ring 250 can be threaded on to release at a lower torque value of "left hand turn" than the other threaded connections, and thus cause the "on-off" tool to break loose.

With the slip or slips 230 set, and the cutter blades 256 typically resting on top of the casing stub, and with the "on-off" tool removed, the string of drill pipe having a drill bit attached at its lower end is run back in the borehole to begin drilling off the whipstock 252 or other exit guide, as the case may be, and into the earth formation. If desired, the exit guide 252 can be oriented before setting the slip 230 as is well known in the art.

Thus, there has been described and illustrated herein the preferred embodiment of the present invention. Modifications to the preferred embodiment will be apparent to those skilled in the art from a reading of the foregoing detailed description and a review of the enclosed drawings. For example, the combined exit guide, for example a whipstock, and the section mill, while being illustrated as being threadedly connected, can be an integral tool which performs all of the functions of the two tools when threadedly connected. Moreover, the downhole packer illustrated in FIG'S. 4, 5 and 6 may be either hydraulically set by well-known valves and associated hydraulic piping, or the packer may be mechanically set either by weight or by rotation of the tubular in manners well known in the art, or the anchoring device may be something other than a packer and may be any one or more of the anchoring devices well-known in the art of drilling oil and gas wells.

In addition, the combination or integral apparatus contemplated by the present invention can be used in open hole operations having no casing. For example, in an open hole from which either a directional well or a sidetracking operation is to be performed, the section mill can be used to cut out into the rock formation surrounding the wellbore and be used to cut away a portion of the formation as the device is lowered in the wellbore and thus bring the exit guide, for example, a whipstock, into an area from which the well or sidetrack is to be drilled. In addition, when using the apparatus according to the present invention in cased boreholes, the steel casing can be cut away for a longer length to enable the use of magnetic field orientation since the steel casing itself tends to disrupt or hinder the magnetic field orientation process. As is well-known in this art, if the magnetic field orientation does not work, it is considered conventional to use gyros to orient the tool. For that reason, it is well-known to sometimes use the section mill to cut further along the casing to enable magnetic field orientation to be used. Moreover, when attempting to orient the exit guide, for example, a whipstock, in the use of the present invention, if the blades are being set down on either the cut away open hole formation or upon the top of the casing, the entire apparatus has to be lifted up to allow the exit guide to be oriented because otherwise the blades will prevent the turning of the exit guide to allow the orientation. Once the orientation is established, then the blades can be set back down on top of the cut away open hole formation or upon the top of the steel casing, as the case may be.

Referring again specifically to FIG. 6 of the drawing, when using the integral or combination apparatus in accordance with the invention, the casing is preferably cut away about 60 ft. While this length will vary depending upon the dimension of the tool or tools and the end utility desired, this depth would allow about 40 ft. for the overall length of the exit guide, for example, a whipstock, and about 20 ft. more between the top of the section mill down to about 2–3 ft. below the blades.

Figure 8:
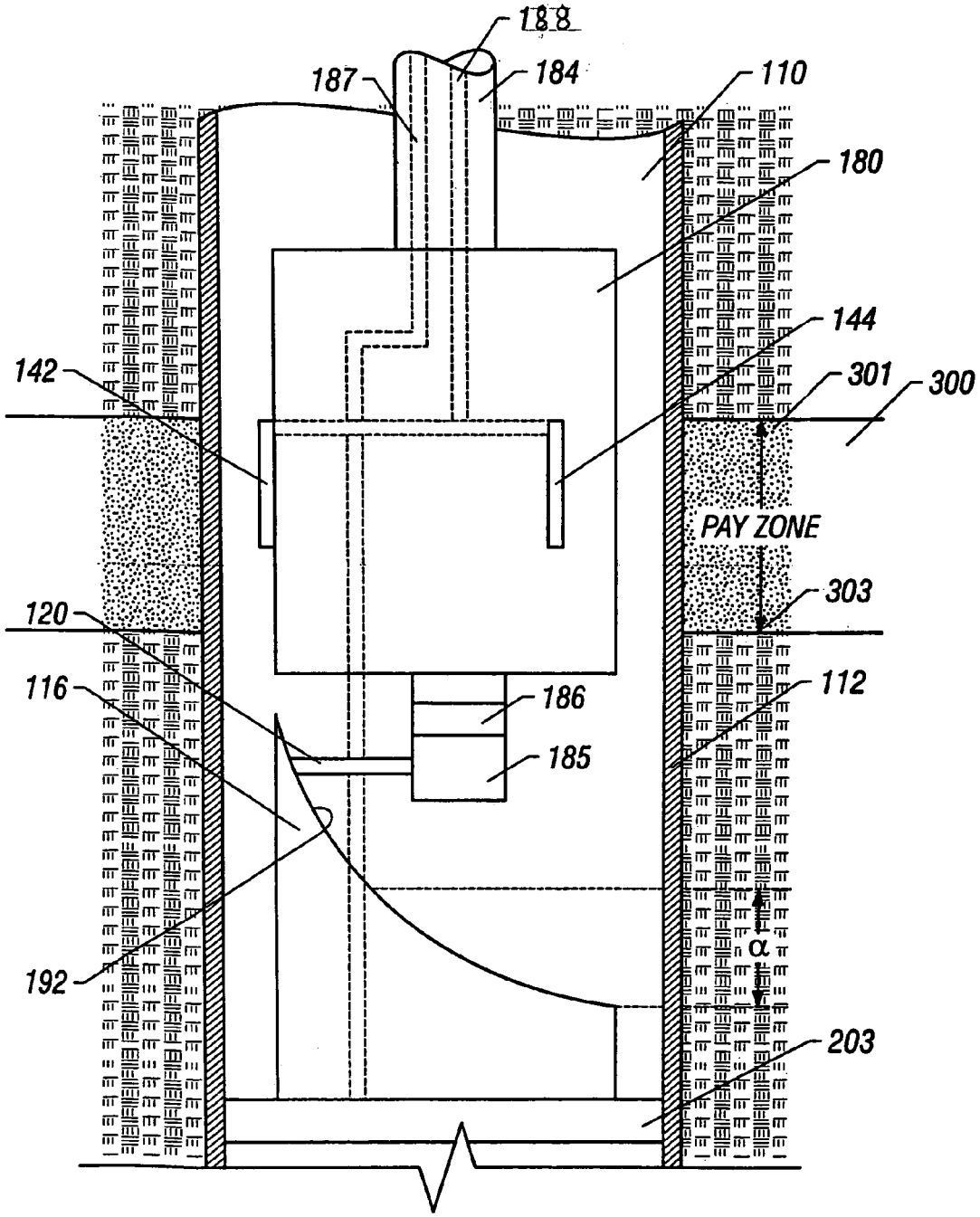
FIG. 8 is a pictorial view of an alternative embodiment of the combined exit guide and section mill which can be used in accordance with the present invention.

Referring now to FIG. 8, an alternative embodiment of the present invention is illustrated as having a section mill 180 connected to a tubular running string 184 which may be, for example, drill pipe. As described above with respect to the equipment illustrated in FIG. 2, the section mill 180 as being conventional and typically having three blades 142, 144 and a third blade which is on the back side of the apparatus and is not visible in FIG. 8. It should be appreciated that the section mill 180 has a supply of hydraulic fluid coming from the earth's surface through the tubular 184 to enable the blades to swing out and cut through the steel casing 112. A short length of tubular material extends out of the lower surface of the section mill 180, and is identified with the numeral 185. The lower extension 185 is connected to the whipstock 116 by shear pin 120. The extension 185 coming out of the lower end of the section mill 180 has a releaseable joint 186 which may be as simple as one or more shear pins, or may be such well-known releaseable joints such as, for example, J-slots which allow the section mill to be separated from the whipstock 116 by manipulating the tubular 184. As is conventional with conventional whipstocks such as the whipstocks 116, the whipstock 116 has a curved surface against which a conventional drill bit can be moved along to drill out through an existing circumferential window in the steel casing 112, as will be explained hereinafter. At the lower end of the whipstock 116, there is a packer which can be either mechanically set, hydraulically set, pneumatically or otherwise set once it is desired to have the whipstock be in place within the casing 112.

It should be appreciated that FIG. 8 illustrates the combination of the section mill 180 and the whipstock 116 being run one direction or the other within the borehole 110 within the confines of the steel casing 112. The combined section mill 180 and the whipstock 116 can be moved upwardly or downwardly within the borehole 110 merely by picking up or lowering the string of tubulars 184 from the earth's surface.

As illustrated further in FIG. 8, the tubular 184 has a pair of hydraulic lines 187 and 188 leading all the way from the earth's surface and the hydraulic equipment needed to actuate those lines down to the equipment illustrated in FIG. 8. As shown in dotted line in FIG. 8, the hydraulic line 187 leads down to the packer 203 which, if hydraulically actuated, will utilize the hydraulic line 187. If the packer 203 is actuated pneumatically or the like, the lines of the hydraulic line 187 will supply whatever fluid is necessary to actuate or deactuate the packer 203. Likewise, the hydraulic line 188 provides hydraulic fluid to actuate the blades 142, 144 and the third blade which is not illustrated in FIG. 8. It should be appreciated that the two hydraulic lines have conventional quick disconnections therein which allows such lines to be disconnected as needed with respect to the embodiments of FIG. 9 and FIG. 10.

In the beginning operation of the equipment illustrated in FIG. 8, the tubular string 188 allows the combined section mill 180 and the whipstock 116 to be positioned in the borehole such that the blades of the section mill 180 can be hydraulically actuated to rotate out and start spinning whenever the blades are opposite the pay zone 300. It should be appreciated that although a section mill can be used to cut while the section mill is being moved upwardly within the cased borehole, such mills work much more efficiently by milling down because they have the weight of the drill string sitting on top of them which thus allows the section mill to utilize the force of gravity which is not available if milling upwardly.

Referring further to FIG. 8, the top of the pay zone 300 is shown as coinciding with the top edge of the cutters 142 and 144 in the section mill 180. Depending upon the thickness of the pay zone 300 as measured between the tips of the arrows 301 and 303 and various other factors which are well-known to those skilled in this art, the section mill can either be raised or lowered prior to commencing the cutting operation to cut through the steel casing 112 at the optimum point. Once the cutting by the section mill has commenced, and as the section mill and the whipstock 116 are moved downwardly in the cutting operation, the length of the cut by the section mill will vary, and will always include a determination as to how long the cut should be and will certainly include the analysis of the amount of space needed to allow the drill bit to fit within the milled out portion as indicated by the dimension (a) in FIG. 8 which are extensions of the lower side of the drill bit as it comes off of the curved surface 192 of the whipstock 116 and also the upper dimension of that same drill bit, with the distance (a) being indicative of the outside diameter of such drill bit.

Figure 9:
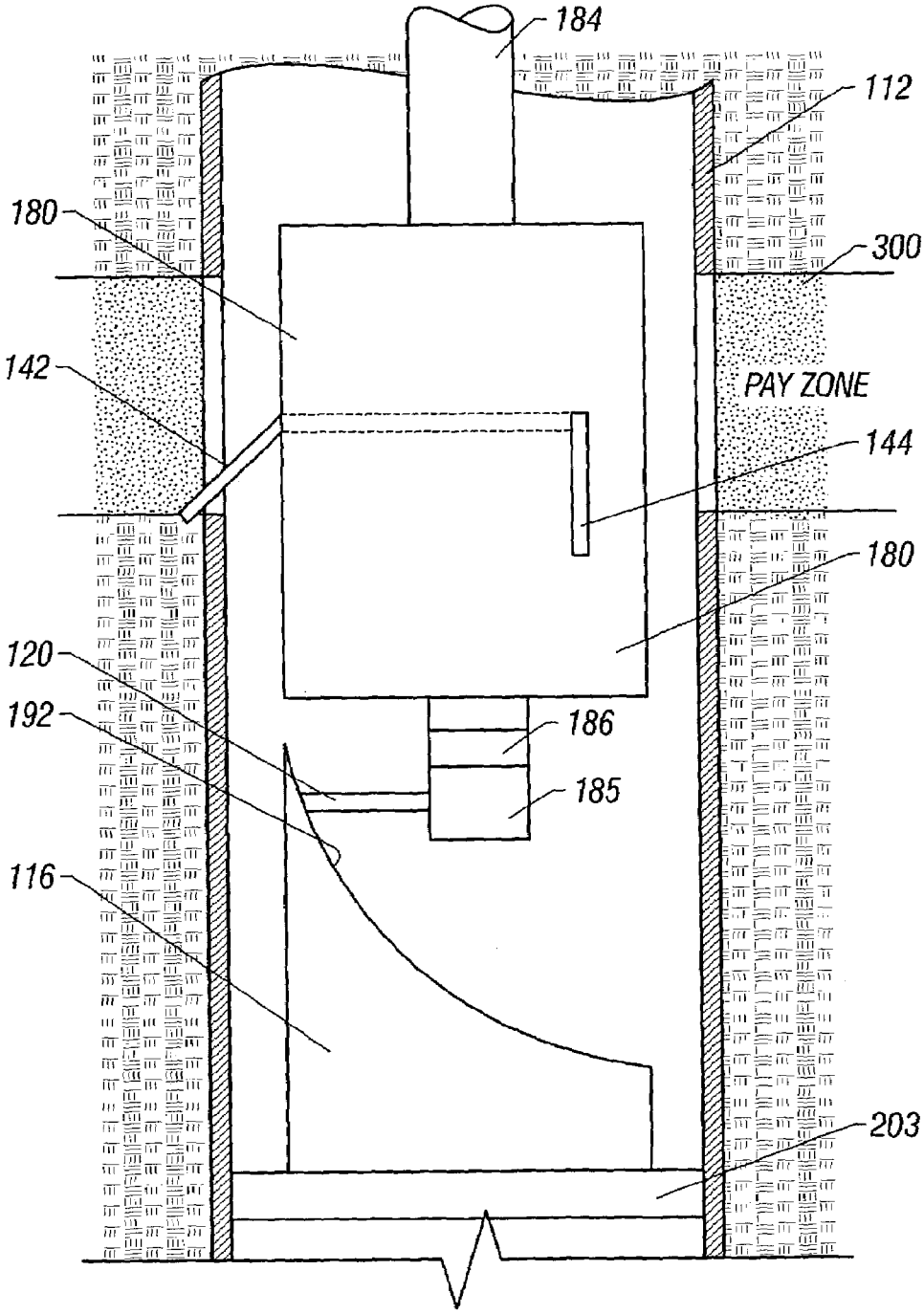
FIG. 9 is a pictorial view of a sequenced event using the combined exit guide and section mill illustrated in FIG. 8.

Referring now to FIG. 9, as the blades of the section mill 180 have cut along a length of the steel casing 112, the formations surrounding the pay zone 300 have been completely exposed. Again, the length of the cut along the length of the steel casing 112 can vary as desired, and may or may not be coincident with the exact depth of the pay zone 300. As illustrated in FIG. 9, and just for the ease of illustration, the exposure of the pay zone is exactly coincident with the depth of the pay zone as measured vertically.

Figure 10:
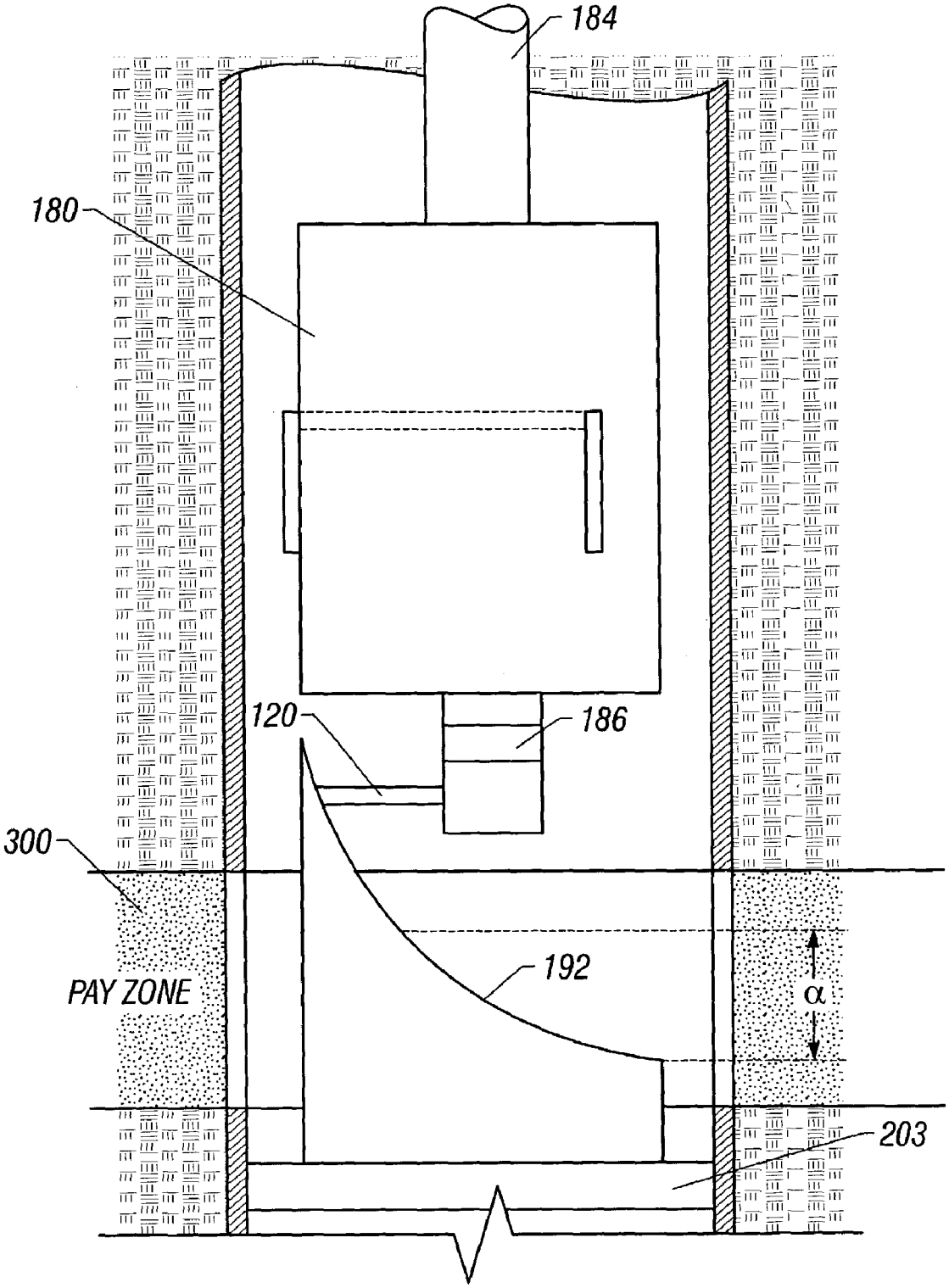
FIG. 10 is a further sequenced view of the combined exit guide and section mill illustrated in FIGS. 8 and 9.

Further in the operation of the apparatus illustrated in FIGS. 8–10, as soon as the pay zone has been exposed as illustrated in FIG. 9, the tubular string 184 is lifted from the earth's surface. At the same time, the blades 142 and 144 can either be burned off as described otherwise herein, or can be retracted to lay against the side of the section mill 180 as soon as the curved surface 192 has been raised up to allow a drill bit to run off of the curved surface 192 into the pay zone, there will be no further lifting of the tubular string 184 and the packer or other anchor assembly 202 can be activated to secure the whipstock 116 within the casing string 112 to allow the drilling operation to proceed.

As illustrated in FIG. 10, the dimension (a) which is also illustrated in FIG. 8, falls within the upper and lower boundaries of the pay zone to allow a drill bit to be run off of the curved surface 192 and allow the pay zone to be penetrated by a drill bit. As soon as the packer 203 has been activated as illustrated in FIG. 10 to have the curved surface 192 of the whipstock 116 adjacent to the pay zone, by pulling up on the tubular string 184, the section mill 180 can be separated from the whipstock 116 through the releaseable connection 186 or through the shear pin 120. In either event, section mill 180 can be transported back to the earth's surface either by running an on-off tool over the section mill 180 or by using the tubular string 184 to transport it back to the surface. In either event, a conventional drill bit can then be attached to the lower end of the tubular string 184 and run back into the borehole to run against the curved surface of the whipstock and into the earth formation including the pay zone 300 and drilling can continue as is known in this art.

It should be appreciated that the embodiment of the present invention as illustrated in FIGS. 8,9 and 10, operates in much the same way as the embodiment of FIGS. 1–7 other than for the section mill being located above the whipstock while being run into the cased borehole, or uncased borehole, as the case may be and that once the section mill has cut away a portion of the steel casing, the entire assembly of the section mill and the whipstock are moved upwardly within the borehole so as to align the whipstock with the pay zone or other area into the which the drilling is to be run through the casing.

Figure 11:
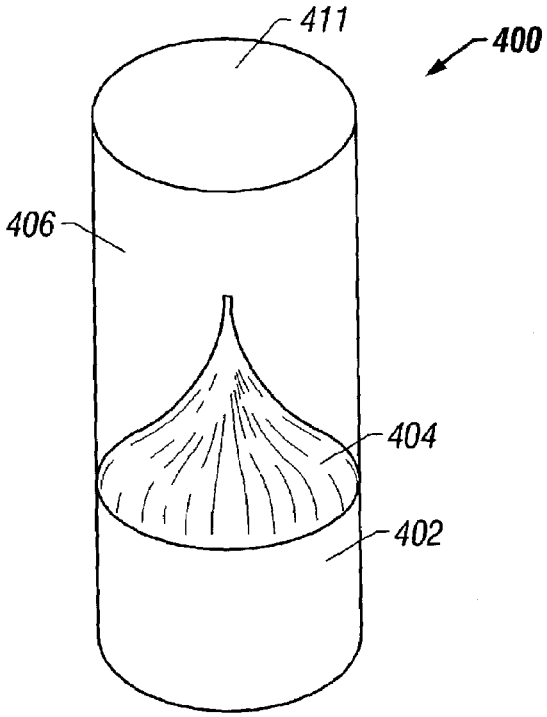
FIG. 11 is a pictorial view of an alternative exit guide which can be used in accordance with the present invention.

Referring now to FIG. 11, there is an alternative embodiment for an exit guide which can be used to provide a surface which the drill bit can run along and run into the formation surrounding the area which has been exposed by the section mill. Instead of using a whipstock, the exit guide illustrated in FIG. 11 can be used. The exit guide 400 illustrated in FIG. 11 is essentially a solid cylinder having a lower portion 402 which can be a solid cylinder or can be a hollow cylinder if desired. A cone shaped portion 404 rests on top of the cylinder 402. Preferably, the cone shaped portion 404 and the lower cylinder 402 are non-drillable, and also preferably comprise a hard metal, for example, stainless steel or other high carbon steels. The exit guide 400 also has an easy drillable portion 406 which may be, for example, fabricated from a hard plastic such as urethane or some other easily drillable material. It should be appreciated that before being drilled, the exit guide 400 is totally cylindrical shaped and it is only after the drill bit starts drilling into the top surface 411 of the exit guide 400 that the cone shaped portion 404 begins to be exposed.

It should be appreciated that the exit guide 400 illustrated in FIG. 11 can be used as a replacement or a substitute for the whipstock either with the embodiments of FIGS. 1–7 or with the embodiment illustrated in FIGS. 8–10.

Figure 12:
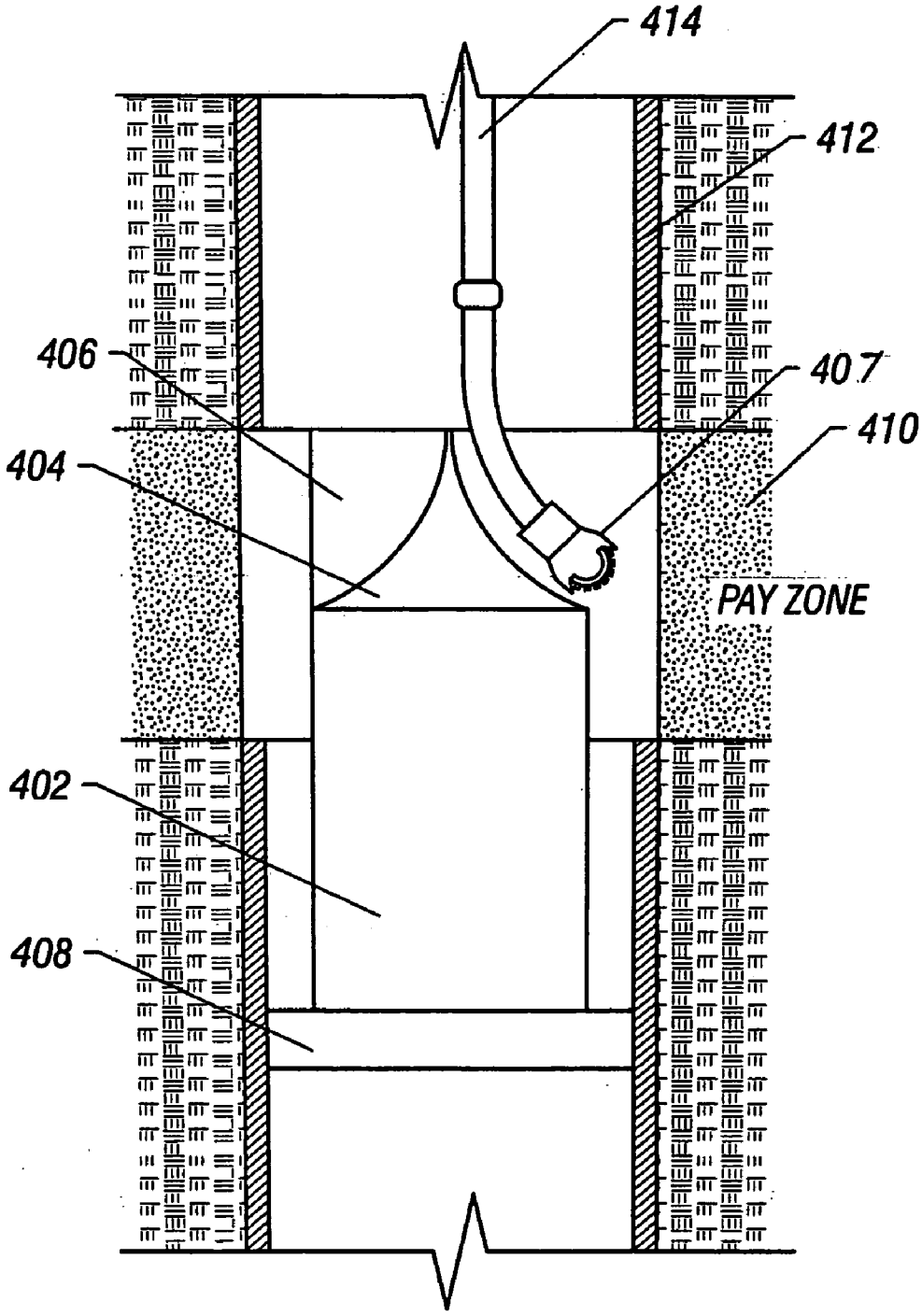
FIG. 12 is an elevated, diagrammatic view of the exit guide illustrated in FIG. 11 used in a borehole to allow a drill bit to be run off the curved surface of the exit guide of FIG. 11.
Figure 13:
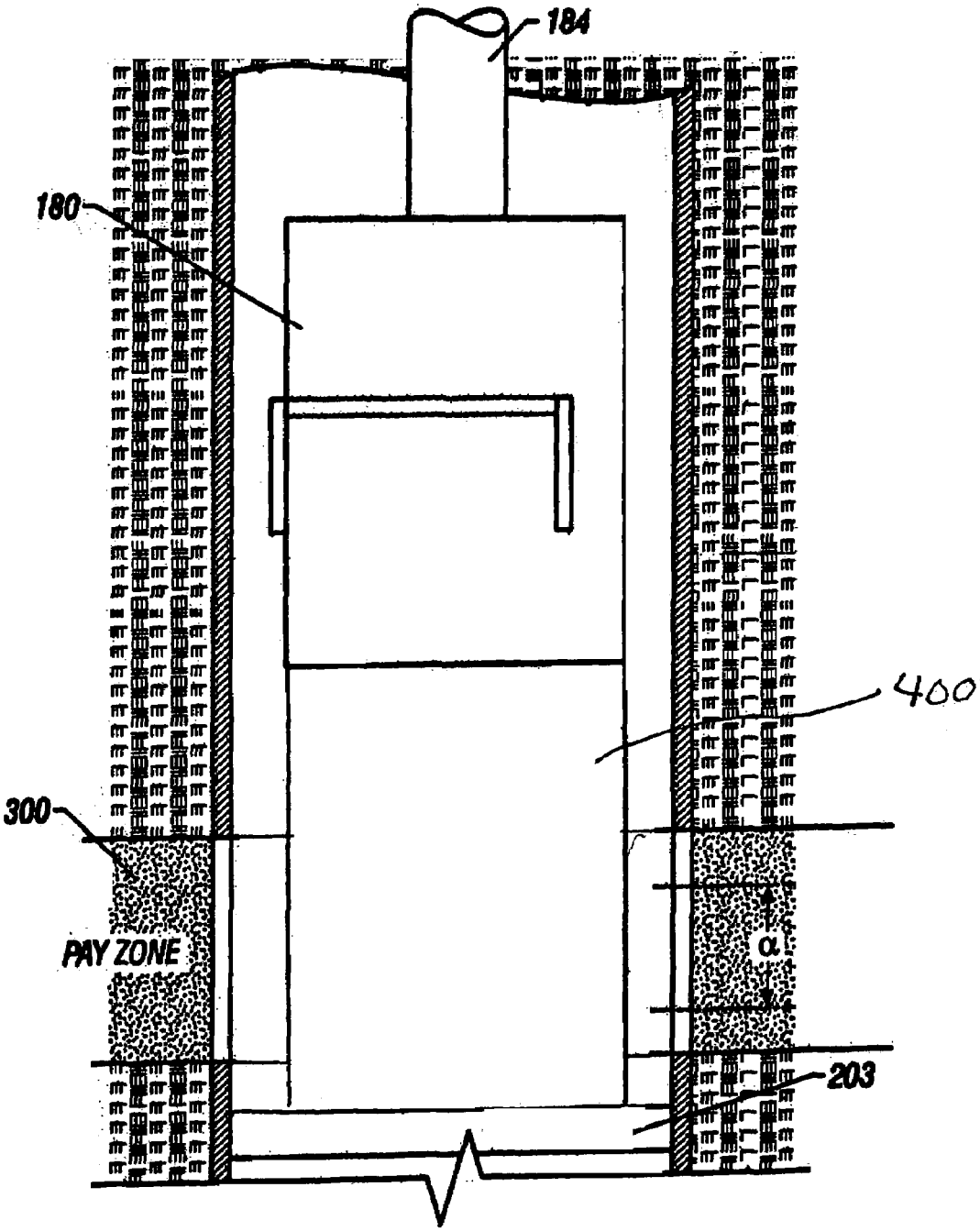
FIG. 13 is an elevated, diagrammatic view of the exit guide illustrated in FIG. 11 being transported simultaneously through a wellbore with a section mill. The use of the exit guide 400 is described in more detail with respect to FIG. 12.

In the operation of the exit guide 400 illustrated in FIG. 11, after the exit guide 400 has been anchored in place within the borehole, cased or uncased, a drill bit is then positioned on the lower end of the tubular string of drill pipe which is run into the borehole until the drill bit touches down against the top surface 411 of the exit guide 400 by using conventional orienting tools such, for example, as are used with downhole mud motors and bent subs, the drill bit can be directed at any angle desired against one of the curved surfaces of the cone 404, as illustrated in FIG. 12, which is a side view of exit guide 400 being drilled off of by a drill bit 407 which is controlled by a string of drill pipe 414 from the earth's surface and which is configured to pass into the pay zone 410 which has previously been exposed by the section mill, not illustrated in FIG. 12, as contemplated by FIGS. 1–10.

In the operation of the apparatus illustrated in FIGS. 11 and 12, as the drill bit 406 engages the top surface 411 illustrated in FIG. 11, after being properly oriented, the drill but 406 drives off the curved surface of the cone 404, cutting away the easily drillable material 406 and will then drill into the pay zone 410. It should be appreciated, that although not illustrated in FIG. 12, the tubular string which would have run in the exit guide 400 with a section mill earlier in the process, has all of the necessary lines, either pneumatic, hydraulic, or the like to activate the packer 408 to allow exit guide 400 to be utilized to allow the drill bit 406 to drill off of its curved surface 404 and pass into the area of interest within the formation, for example, the pay zone 410.

Figure 11A:
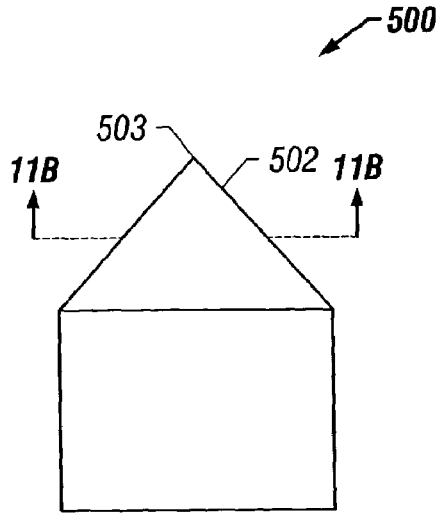
FIG. 11A is an elevated, diagrammatic view of an alternative cone according to the present invention.
Figure 11B:
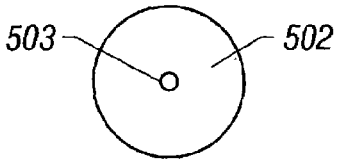
FIG. 11B is a top plan view of the cone taken along the section line 11—11 of FIG. 11A.

Referring now to FIG. 1A, there is illustrated an alternative embodiment of the cone 500 having linear surfaces instead of the curved surfaces illustrated above with respect to the exit guide 400. There is an infinite number of linear surfaces 502 leading to the apex 503, also as is illustrated in FIG. 11B. FIG. 11B is a top plan view, taken along the section lines 11—11 of FIG. 11A. As illustrated in FIG. 11A, each of the surfaces 502 of FIG. 11A and each of the surfaces of the cone illustrated in FIG. 11 are continuous, respectively and each of those two cones is contemplated to be embedded within the hard plastic 406 illustrated in FIG. 11. Rather than illustrating the cone 404 in dotted line within the plastic 406, the drawing assumes that the hard plastic 406 is transparent to enable the cone 404 to be illustrated as being embedded therein.

Figure 11C:
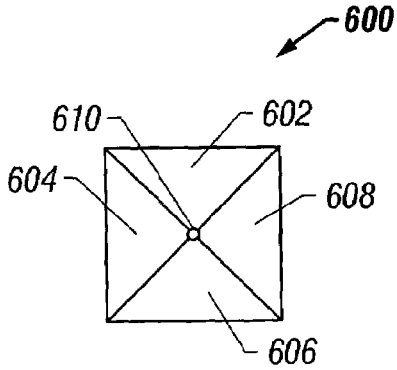
FIG. 11C is a top plan view of a pyramid having four surfaces leading to an apex.

Referring now to FIG. 1C, instead of using a cone leading to an apex, FIG. 11C illustrates a top plan view of a pyramid 600 in which the four surfaces 602, 604, 606 and 608 all lead to an apex 610. It should be appreciated that the surfaces 602, 604, 606 and 608 are discontinuous with respect to each other.

Figure 11D:
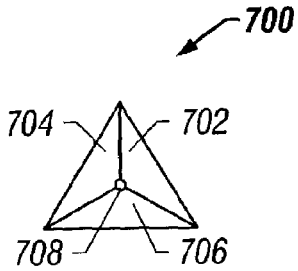
FIG. 11D is a top plan view of a pyramid having three surfaces leading to an apex.
Figure 11E:
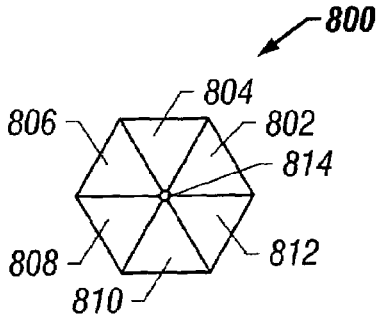
FIG. 11E is a top plan view of a pyramid having six surfaces leading to an apex.

Similarly, FIG. 11D illustrates a three sided pyramid having discontinuous surfaces 702, 704 and 706 leading to an apex 708. In a similar vein, FIG. 11E illustrates a six sided pyramid 800 having surfaces 802, 804, 806, 808, 810 and 812, all leading to an apex 814. It is contemplated by this invention that anyone of the pyramids such as are illustrated in FIG. 11C, FIG. 11D and FIG. 11E, or any other pyramid having a given number of surfaces, will likewise be embedded in a plastic body such as the body 406 illustrated in FIG. 11.

In the operation of the embodiments illustrated in FIGS. 11C, 11D and 11E, whenever the drill bit hits the top surface of the plastic encasement for the pyramid, such as the hard plastic 406 of FIG. 11, only after the drill bit has been oriented to go a particular direction along one of those surfaces, the drill bit will drill through the hard plastic and then strike one of the tapered surfaces, and then travel into the earth formation which has been exposed by cutting away the steel casing with the section mill as above described with the other embodiments. Although only pyramids having only 3, 4 or 6 surfaces are illustrated and described herein, the invention contemplates that any pyramid having any given number of discontinuous surfaces is contemplated by the present invention, If the number of such surfaces grows large enough, it will be analogous to having an infinite number of discontinuous surfaces which then become a continuous surface.

It should be appreciated that depending on the type of plastic which is used to embed either a cone or a pyramid, as illustrated herein, the drill bit may shatter or break away a good portion of the plastic 406, but it is much preferred that the plastic be chosen to allow the drill bit to cut a trough or even a tunnel in the hard plastic, for example, urethane and in so doing, follow either the curvature of the cone 404 or the tapered linear surface of the cone 500 and then proceed into the earth formation as has been exposed by the section mill. In this event, the hard plastic will partially or even totally contain the drill bit to prevent it from wobbling as it goes along the surface. The same thing can be true when using one of the pyramid structures of FIGS. 11C, 11D, 11E or the like, although certainly, the preferred embodiment will be specifically the cone 500 of FIG. 11A or even more preferably, the cone illustrated in FIG. 11 which has a curved surface.

It should be appreciated that this invention contemplates the use of any exit guide having a tapered surface along which the drill bit may be run prior to entering the exposed formation. It should also be appreciated that FIGS. 1–8 relate to transporting the exit guide above the section mill and FIGS. 8–10 contemplate the section mill being run above the exit guide. As used in the claims herein, "above" and "below" relate to the position of the two pieces of apparatus with respect to when they are first being run into an earth borehole and such positioning has that same

The invention claimed is:

1. An apparatus for sidetracking or drilling directional oil and gas wells, wherein said apparatus is transported through such wells by a string of tubulars, comprising;

a string of tubulars;

an exit guide having a surface along which a drill bit can travel to enable such sidetracking or directional drilling; and a section mill, said exit guide and said section mill being transported simultaneously through at least one of said wells by said string of tubulars.

2. Apparatus according to claim 1 wherein said exit guide and said section mill comprise an integrated unit.

3. The apparatus according to claim 1 wherein said exit guide and said section mill are separate units but connected together within the apparatus.

4. The apparatus according to claim 1 wherein said section mill is operated by hydraulic fluid passing from the earths's surface through said tubulars and into said section mill.

5. The apparatus according to claim 1 including in addition thereto, an on-off tool carried by said tubular string which allows the tubular string to be connected to or released from said exit guide.

6. The apparatus according to claim 1 including in addition thereto, a downhole packer assembly which can be used to anchor the exit guide and section mill at determined locations within the earth borehole.

7. The apparatus according to claim 1, wherein said exit guide comprises a non-drillable cone embedded within an easy drillable material.

8. The apparatus according to claim 7, wherein said cone comprises an apex and a plurality of surfaces tapering towards said apex along which said drill bit can travel.

9. The apparatus according to claim 8, wherein each of said surfaces is concave as viewed from a location exterior to each said surface.

10. The apparatus according to claim 8, wherein each of said surfaces is linear as viewed from a location exterior to each said surfaces.

11. The apparatus according to claim 7 wherein said easy drillable material comprises a hard plastic.

12. The apparatus according to claim 11, wherein said hard plastic comprises urethane.

13. The apparatus according to claim 1, wherein said exit guide comprises a cylindrical body of easy drillable material.

14. The apparatus according to claim 1, wherein said exit guide is located above said section mill while being transported through at least one of said wells.

15. The apparatus according to claim 1, wherein said exit guide is located below said section mill while being transported through at least one of said wells.

16. A method for sidetracking or directional drilling from existing earth wellbores, comprising the steps of running into the existing wellbore having a pay zone formation surrounding said wellbore a combined exit guide and section mill connected to a string of drill pipe until the section mill is adjacent the pay zone formation surrounding said wellbore, said exit guide having a surface along which a drill bit can travel to enable such sidetracking or directional drilling, activating said section mill and lowering said activated section mill until the exit guide located above the section mill is in proximity to the pay zone formation; and running a drill bit connected to a section of drill pipe along the surface of the exit guide and into the formation adjacent said existing wellbore.

17. The method according to claim 16 wherein said existing wellbore is cased.

18. The method according to claim 17 including in addition thereto, the step of anchoring the combined exit guide and section mill to the interior of the wellbore casing prior to running a drill bit along the surface of the exit guide.

19. The method according to claim 18 wherein the section mill has a plurality of section mill blades, and wherein said anchoring step comprises the use of the section mill blades resting on top of the casing adjacent the milled out section of the casing.

20. The method according to claim 18 wherein said anchoring step comprises the use of a downhole packer assembly to anchor the whipstock and the section mill to the interior of the casing.

21. The method according to claim 16 wherein said existing wellbore is uncased.

22. A method for sidetracking or directional drilling from an existing earth wellbore having a pay zone formation surrounding said wellbore, comprising:

running into the existing wellbore a combined exit guide and section mill connected to a string of drill pipe until the section mill is adjacent said pay zone formation, said exit guide having a surface along which a drill bit can travel to enable such sidetracking or directional drilling;

activating said section mill to mill along said pay zone formation;

transporting said exit guide until said exit guide is in proximity to said pay zone formation; and running a drill bit connected to a string of drill pipe along the surface of the exit guide and into the pay zone formation surrounding said wellbore.

23. A method for sidetracking or directional drilling from an existing earth wellbore into the earth formation surrounding said borehole, comprising:

running into the existing wellbore a combined exit guide and section mill connected to a string of drill pipe until the section mill is located at a first predetermined depth in said wellbore, said exit guide having a surface along which a drill bit can travel to enable such sidetracking or directional drilling;

activating said section mill to mill along from said first predetermined depth to a second predetermined depth in said borehole;

transporting said exit guide through said well until said exit guide is in proximity to the earth formation surrounding said borehole between said first and second predetermined depths in said borehole; and running a drill bit connected to a string of drill pipe along the surface of the exit guide and into the earth formation surrounding said wellbore.

24. The method according to claim 23, wherein said wellbore is cased.

25. The method according to claim 23, wherein said wellbore is uncased.

26. A method for sidetracking or directional drilling from an existing earth wellbore having a pay zone formation surrounding said wellbore, comprising:

running into the existing wellbore a combined exit guide and section mill connected to a string of drill pipe until the section mill is adjacent said pay zone formation, said exit guide having a surface along which a drill bit can travel to enable such sidetracking or directional drilling;

activating said section mill to mill along said pay zone formation;

transporting said exit guide upwardly until said exit guide is in proximity to said pay zone formation; and running a drill bit connected to a string of drill pipe along the surface of the exit guide and into the pay zone formation surrounding said wellbore.

27. The method according to claim 26, wherein said surface is curved.

28. The method according to claim 26, wherein said surface is linear.

29. A method for sidetracking or directional drilling from an existing earth wellbore having a pay zone formation surrounding said wellbore, comprising:

running into the existing wellbore a combined exit guide and section mill connected to a string of drill pipe until the section mill is adjacent said pay zone formation, said exit guide having a surface along which a drill bit can travel to enable such sidetracking or directional drilling;

activating said section mill to mill along said pay zone formation;

transporting said exit guide downwardly until said exit guide is in proximity to said pay zone formation; and running a drill bit connected to a string of drill pipe along the surface of the exit guide and into the pay zone formation surrounding said wellbore.

30. The method according to claim 29 wherein said surface is curved.

31. The method according to claim 29 wherein said surface is linear.

32. An exit guide for use in sidetracking or drilling of directional oil and gas wells, comprising:

a first body sized to be transported through an oil and/or gas well, said first body being fabricated from at least one easily drillable material; and a second body being embedded within said first body, said second body comprised of at least one material which is not easily drillable, said second body having at least one surface along which a drill bit can travel to enable such sidetracking or directional drilling.

33. The exit guide according to claim 32, wherein said first body is fabricated from hard plastic.

34. The exit guide according to claim 33, wherein said hard plastic comprises urethane and/or polyurethane.

35. The exit guide according to claim 32, wherein said at least one surface is curved.

36. The exit guide according to claim 32, wherein said at least one surface is linear.

37. The exit guide according to claim 32, wherein said at least one surface comprises a plurality of continuous surfaces.

38. The exit guide according to claim 37, wherein said plurality of continuous surfaces comprise a cone.

39. The exit guide according to claim 32, wherein said at least one surface comprises a plurality of discontinuous surfaces.

40. The exit guide according to claim 39, wherein said plurality of discontinuous surfaces comprise a pyramid.

* * * * *